US006547471B1

(12) United States Patent
Tucker et al.

(10) Patent No.: US 6,547,471 B1
(45) Date of Patent: Apr. 15, 2003

(54) LIQUID APPLICATOR

(75) Inventors: William E. Tucker, Attleboro, MA (US); William T. O'Connor, Londonderry, NH (US); Timothy G. Kerrissey, Braintree, MA (US); Steven M. Bourque, Bradford, MA (US)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 09/620,079

(22) Filed: Jul. 20, 2000

(51) Int. Cl.[7] ..... B43K 5/00
(52) U.S. Cl. ..... 401/206; 401/205; 401/183
(58) Field of Search ..... 401/205, 202, 401/206, 262, 263, 266, 183, 184, 185

(56) References Cited

U.S. PATENT DOCUMENTS

| | | | | | |
|---|---|---|---|---|---|
| 2,716,250 | A | * | 8/1955 | Deakers | 401/205 |
| 3,281,887 | A | * | 11/1966 | Raffe | 401/263 |
| 4,111,567 | A | * | 9/1978 | Berghahn | 401/205 |
| 4,983,061 | A | | 1/1991 | Demarest | 401/148 |
| 5,120,148 | A | | 6/1992 | Waters et al. | 401/264 |
| 5,230,579 | A | | 7/1993 | Klawson et al. | 401/205 |
| 5,567,073 | A | | 10/1996 | Laforcade et al. | 401/190 |
| 5,908,256 | A | * | 6/1999 | Bernstein | 401/186 |
| 6,030,138 | A | | 2/2000 | Losier | 401/266 |

* cited by examiner

*Primary Examiner*—David J. Walczak
(74) *Attorney, Agent, or Firm*—Fish & Richardson P.C.

(57) ABSTRACT

An applicator for local application of a liquid to a person's skin. The applicator includes a porous dome, a chamber under the dome, a squeeze bottle providing a reservoir containing the liquid, and a tube from the squeeze bottle to the chamber. The porous dome has pores sized to provide liquid transport therein by capillary action. The chamber provides a location for liquid in position to be transported into dome. Increased pressure in the reservoir from squeezing the bottle causes liquid to flow from the reservoir through the tube to the chamber, and decreased pressure in the reservoir from releasing the bottle causes excess liquid in the chamber to flow from the chamber through the tube to the reservoir. The applicator can include a squeeze bottle having a relatively rigid molded open-end portion connected to a porous dome and an integral flexible, blow-molded reservoir portion that can be squeezed to a reduced volume condition to deliver liquid to the dome and has memory to return to an unsqueezed volume condition.

26 Claims, 6 Drawing Sheets

LIQUID APPLICATOR

BACKGROUND

The invention relates to an applicator that can be used for the local application of a liquid product to a person's skin.

Personal use products such as antiperspirants, deodorants and cosmetics can be applied to a user's skin in various forms by various devices. For example, deodorants and/or antiperspirants can be delivered as a spray from a pressurized container or a spray bottle, as a solid from a solid stick dispenser, or as a liquid from a roll-on applicator or a porous dome applicator.

SUMMARY

In one aspect, the invention features, in general, an applicator for local application of a liquid to a person's skin. The applicator includes a porous dome, a chamber under the dome, a squeeze bottle providing a reservoir containing the liquid, and a tube from the squeeze bottle to the chamber. The porous dome has pores sized to provide liquid transport therein by capillary action. The chamber provides a location for liquid in position to be transported into dome. Increased pressure in the reservoir from squeezing the bottle causes liquid to flow from the reservoir through the tube to the chamber, and decreased pressure in the reservoir from releasing the bottle causes excess liquid in the chamber to flow from the chamber through the tube to the reservoir.

In another aspect, the invention features, in general, an applicator for local application of a liquid to a person's skin that includes a porous dome, a squeeze bottle providing a reservoir containing the liquid, and a tube to convey liquid from the squeeze bottle to the dome. The bottle is made of a relatively rigid plastic (e.g., polyethylene terephthalate) and includes a relatively rigid, molded open-end portion connected to the dome and an integral flexible, blow-molded reservoir portion that can be squeezed to a reduced volume condition to deliver liquid to the dome and has a memory to return to an unsqueezed volume condition.

Particular embodiments of the invention may include one or more of the following features. The applicator can include a valve operable to block flow through the tube, and a cap that causes the valve to be closed when the cap is connected to the squeeze bottle. The applicator can include a dome adapter located between the squeeze bottle and the porous dome, such that the chamber providing liquid to the porous dome is defined by the dome adapter and the porous dome. The dome adapter can have a central passage and a valve structure at the bottom of the central passage, the valve structure being in fluid communication with the tube. A collar can be used to connect the dome adapter to the porous dome. The applicator can include a bottle adapter connected to the bottle, with the porous dome being movably mounted with respect to the bottle adapter. The collar can be slidably mounted with respect to the bottle adapter. The bottle adapter can have a central portion that is sealably connected to the tube and has an opening in communication with the tube. The applicator can have a spring between the bottle adapter and the dome adapter that biases the valve structure away from the opening. The dome adapter can include a sliding seal with the bottle adapter around the opening. The bottle adapter can snap onto the squeeze bottle.

The chamber and porous dome are preferably dimensioned and shaped so as to provide preferential blooming of the liquid at the center of the dome first and subsequent blooming of liquid closer to the periphery of the dome. The chamber and dome are also dimensioned and shaped so that, when the user releases the squeeze bottle, excess liquid on the top of the dome is pulled back into the applicator, and is preferentially first removed from the peripheral portions and then from the central portion. The chamber can have a central volume area that communicates with the tube, a peripheral volume area, and a constricted region connecting the central volume area to the peripheral volume area to provide the preferential blooming. The porous dome has a stepped recess surface with a central recess that provides the central volume area and a peripheral recess that provides the peripheral volume area.

The porous dome is preferably made of sintered plastic, e.g., sintered high-density polyethylene, and preferably is made of round particles to provide a smooth surface for contacting the skin. The sintered plastic has an average pore size between 10 and 30 microns, preferably around 18 microns.

Embodiments of the invention may include one or more of the following advantages. The applicator provides a uniform dose of liquid to the porous dome without large droplets on the dome surface or drips down the side of the applicator. A uniform, thin layer of liquid is applied to the user's skin surface without irritation. The applicator does not leak liquid, and is easy to manufacture.

Other features and advantages of the invention will be apparent from the following detailed description of a particular embodiment thereof and from the claims.

DETAILED DESCRIPTION

Figure 1:
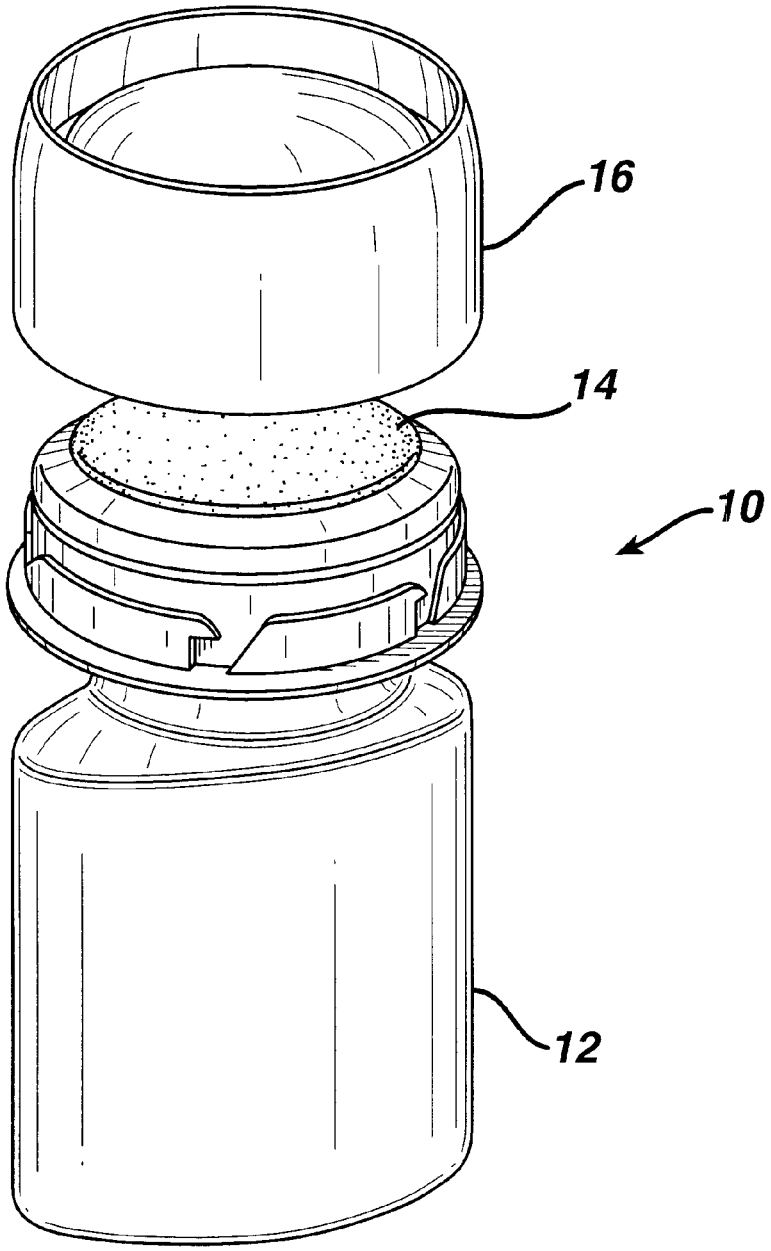
FIG. 1 is a perspective view of a liquid applicator shown with a cap.

Referring to FIG. 1, there is shown liquid applicator 10 including squeeze bottle 12, porous dome 14 and removable cap 16.

Figure 2:
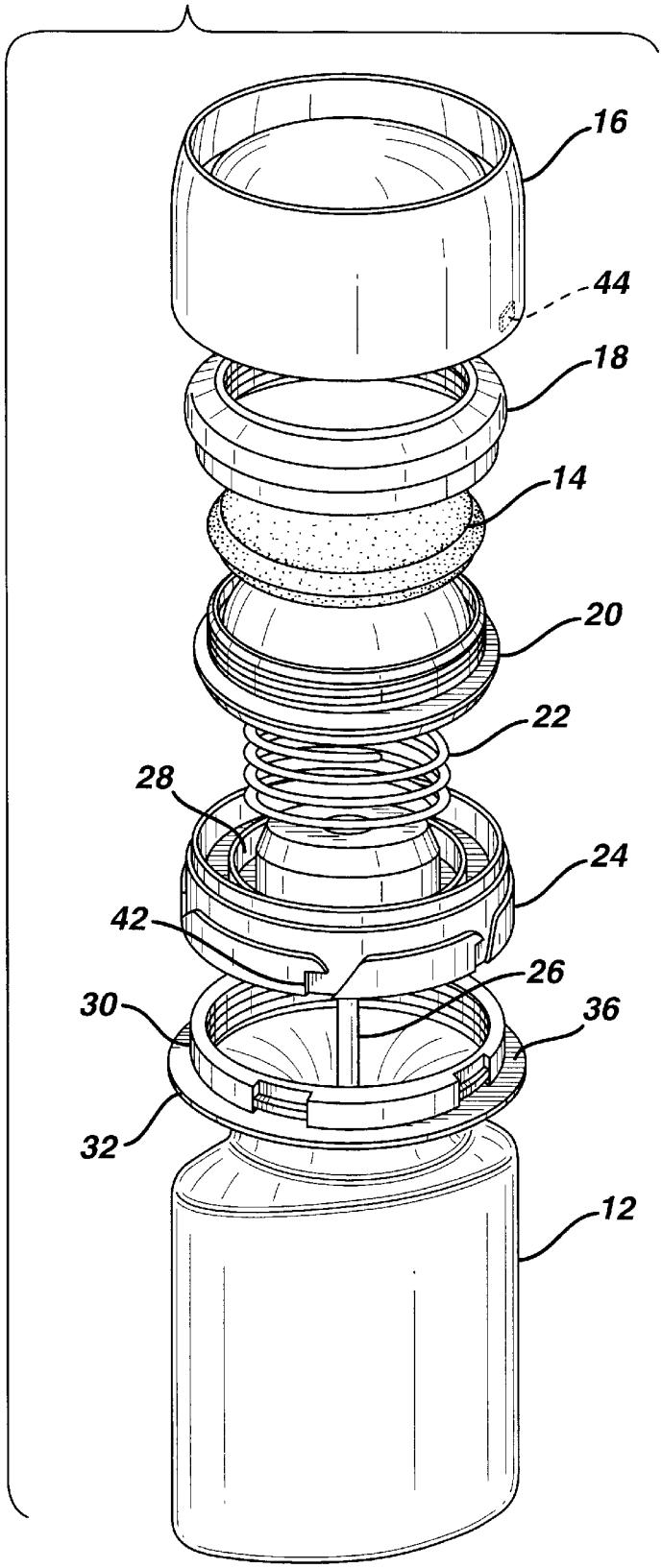
FIG. 2 is an exploded perspective view of the FIG. 1 applicator and cap.
Figure 2A:
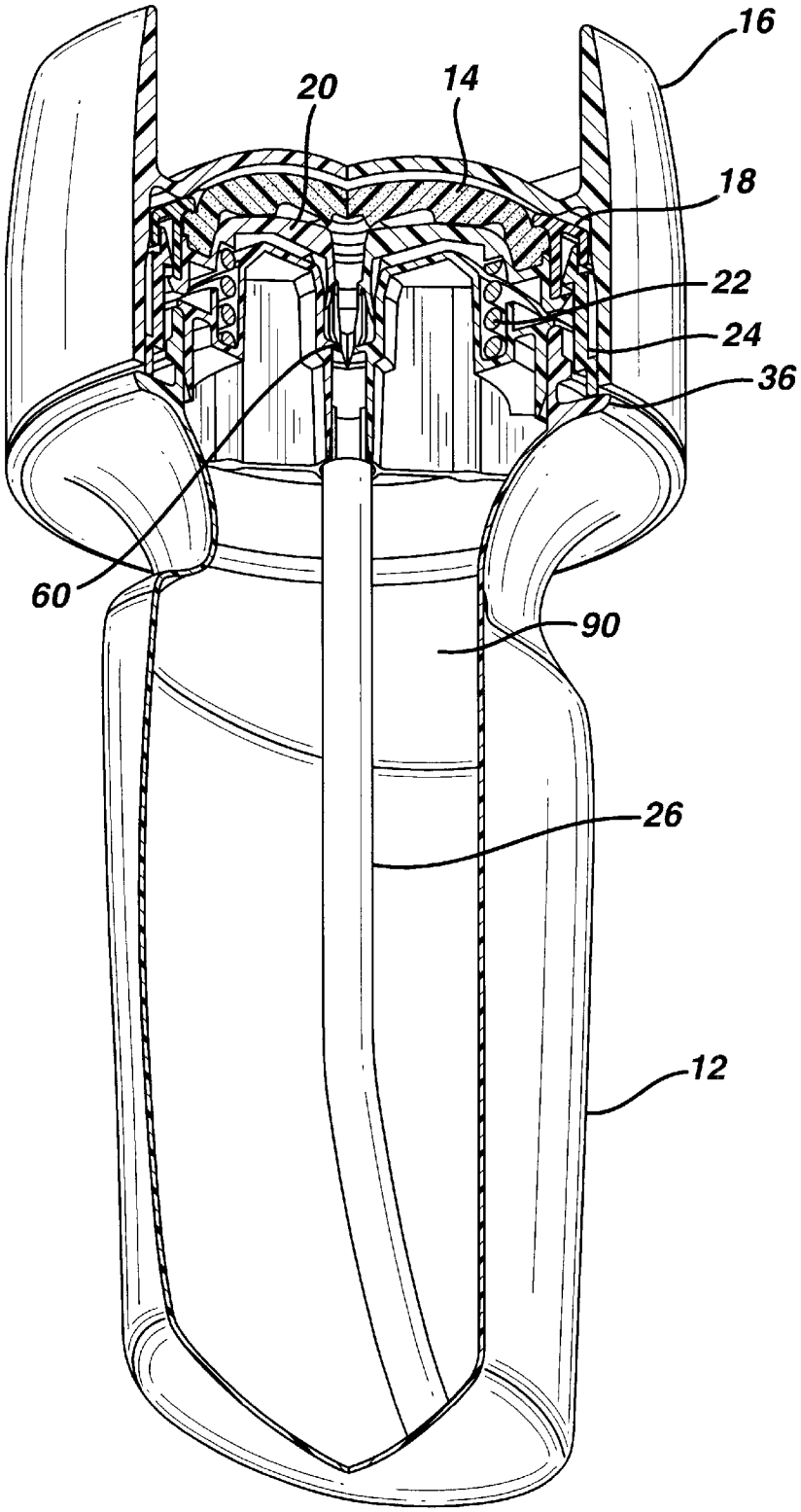
FIG. 2A is a perspective view, partially cut away, of the FIG. 1 applicator and cap.

Referring to the exploded diagram shown in FIG. 2 and the cut away view of FIG. 2A, it is seen that porous dome 14 is connected to squeeze bottle 12 by various components. These include collar 18, dome adapter 20, spring 22, bottle adapter 24, and dip tube 26. Spring 22 sits in annular recess 28 in bottle adapter 24. Collar 18 makes a snap-fit connection to dome adapter 20 in order to retain porous dome 14 thereon. The combined unit of collar 18, dome adapter 20 and porous dome 14 make a snap fit connection onto bottle adapter 24 with the combined unit being slidably movable on bottle adapter 24 and biased upward by spring 22. Bottle adapter 24 makes a snap-fit connection to the upper connecting end 30 of squeeze bottle 12, which has a snap connector 32.

Bottle 12 is made of molded and blow molded polyethylene terephthalate. Alternatively, other relatively rigid plastics (e.g., ethylene vinyl alcohol) can be used, depending on compatibility with the liquid being dispensed. The plastic should be rigid enough to provide sufficient mechanical molded strength to mechanically connect and seal to bottle adapter 24 at molded, upper connecting end 30, but also be capable of being blow-molded at the lower portion to provide a flexible wall that can be squeezed and that returns to its initial position when released.

Porous dome 14 is made of sintered high-density polyethylene. Cap 16, collar 18, dome adapter 20, and bottle adapter 24 are made of polypropylene. Dip tube 26 is made of polyethylene.

Figure 3:
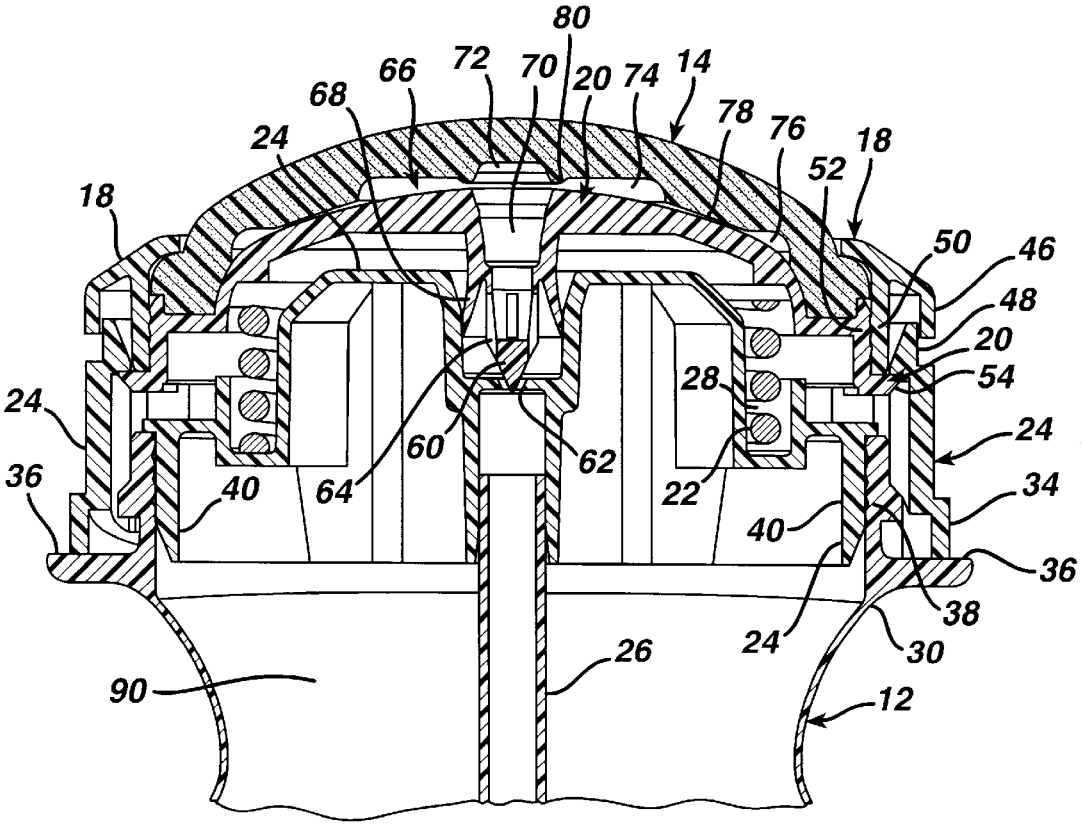
FIG. 3 is a partial vertical sectional view of the FIG. 1 applicator without its cap and with the applicator components in an operative, open position.
Figure 3A:
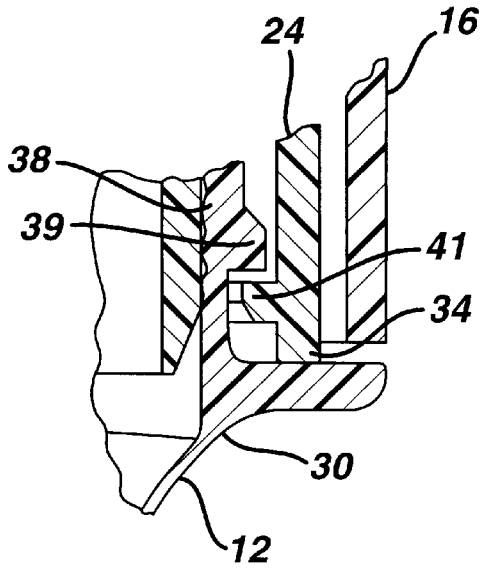
FIG. 3A is a partial vertical sectional view of the FIG. 1 applicator taken at a different location than for FIG. 3.
Figure 3B:
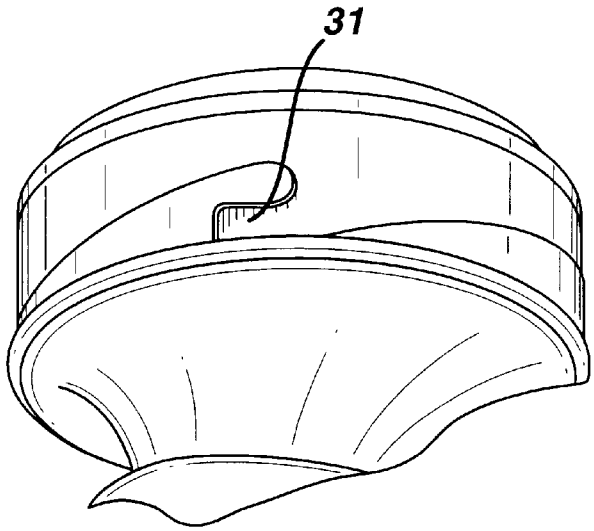
FIG. 3B is a partial perspective view of an alternative embodiment of the FIG. 1 applicator.

Referring to FIG. 3, it is seen that bottle adapter 24 has an outer annular portion 34 that rests on top of flange 36 of connecting end 30 of squeeze bottle 12 outside of annular extension 38 of squeeze bottle 12. Bottle adapter 24 also has an inner annular portion 40 that is located inside of annular extension 38 and makes a seal between squeeze bottle 12 and bottle adapter 24. Tab 39 (FIG. 3A) of extension 38 locks with tab 41 of portion 34 to provide a snap-fit connection of bottle adapter 24 to connecting end 30 of bottle 12. Outer annular portion 34 contains helical grooves 42 (FIG. 2) for mating with projections 44 on the inside of cap 16 in order to positively lock cap 16 in the precise, desired axial position on connecting end 30 so as to guarantee valve closure, as described below. Other types of locking closures can be used, e.g., using groove 31 as shown in FIG. 3B Still referring to FIG. 3, collar 18 has an outer annular portion 46 that slides on the outside of upper extension 48 of annular portion 34 of bottle adapter 24. Collar 18 also has inner annular portion 50 that slides on the inside of extension 48. Inner annular portion 50 is sealably connected to lower wall 52 of dome adapter 20. Collar 18 locks porous dome 14 in position between collar 18 and dome adapter 20 so that the three components move as a combined unit on bottle adapter 24.

Spring 22 pushes dome adapter 20 upward to the upper position shown in FIG. 3. Tab 54 on dome adaptor 20 acts as a stop against the lower shelf portion of extension 48, preventing dome adapter 20 and the attached components from going higher. Dome adapter 20 carries, at its center, valve structure 60, which is positioned over opening 62 in bottle adapter 24. In the position shown in FIG. 3, valve 60 is spaced from opening 62 slightly, such that liquid from tube 26 can pass through opening 62 and upward through slots 64 to the chamber 66 defined between porous dome 14 and dome adapter 20. Cylindrical extension 68 at the center of dome adapter 20 provides a sliding, liquid-tight seal between dome adapter 20 and bottle adapter 24 so that the liquid cannot flow into the area containing spring 22 but instead is directed up through central passage 70 to chamber 66.

Porous dome 14 has a stepped recess lower surface including central recess 72, intermediate annular recess 74, and peripheral annular recess 76. Intermediate recess 74 communicates with peripheral recess 76 by restricted region 78. Intermediate recess 74 similarly communicates with central recess 72 to via restricted region 80. Porous dome 14 is made of sintered round particles of high density polyethylene and has an average pore size between 10 and 30 microns, preferably around 18 microns.

The snap fit connections for all parts in applicator 10 provide for ease of manufacture.

Figure 4:
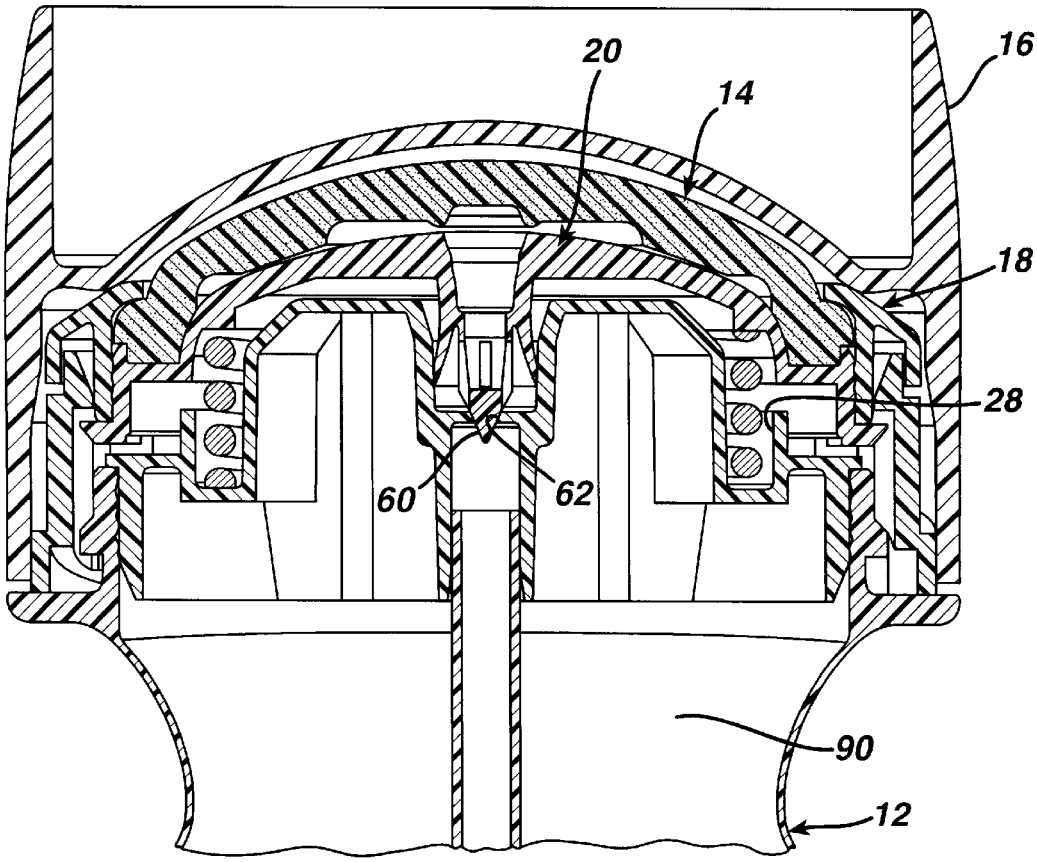
FIG. 4 is a partial sectional view of the FIG. 1 dispenser with its cap and with the applicator components in an inoperative, closed position.

When using applicator 10, the user first twists cap 16 relative to bottle 12 to release projections 44 from the locked positions in grooves 42. As cap 16 is removed, valve structure 60 is moved from the closed position shown in FIG. 4 to the open position shown in FIG. 3. This action occurs because spring 22 is now free to move dome adapter 20 upward from bottle adapter 24 until tab 54 reaches the stop position. With valve 60 in the open position, there is a fluid communication from reservoir 90 to chamber 66 through tube 26.

When the user squeezes bottle 12, the decreased volume and increased pressure in reservoir 90 causes liquid to flow through tube 26 and opening 62, slots 64 and central passage 70 into chamber 66. The liquid is first directed to the central recess 72 and is delayed in travel into intermediate recess 74 owing to the small flow area of restricted region 80. As further liquid is pumped up to central recess 72, owing to the increased pressure in reservoir 90, the liquid from intermediate recess 74 can continue outward to peripheral recess 76. By this time, the Liquid that had initially entered recess 72 has been transported by capillary action and pressure displacement to the upper surface of dome 14. Shortly thereafter, liquid from the intermediate annular recess 74 passes through dome 14 to the intermediate region of the upper surface of dome 14, and lastly liquid from peripheral portion 76 passes to the upper surface of dome 14. The liquid passes through the pores in porous dome 14 by capillary action and by positive pressure displacement. The pores in dome 14 are sufficiently large to permit flow of the proper amount of liquid, but small enough to avoid formation of large droplets on the surface.

When the user squeezes bottle 12, the decreased volume and increased pressure in reservoir 90 causes liquid to flow through tube 26 and opening 62, slots 64 and central passage 70 into chamber 66. The liquid is first directed to the central recess 72 and is delayed in travel into intermediate recess 74 owing to the small flow area of restricted region 80. As further liquid is pumped up to central recess 72, owing to the increased pressure in reservoir 90, the liquid from intermediate recess 74 can continue outward to peripheral recess 76. By this time, the Liquid that had initially entered recess 72 has been transported by capillary action and pressure displacement to the upper surface of dome 14. Shortly thereafter, liquid from the intermediate annular recess 74 passes through dome 14 to the intermediate region of the upper surface of dome 14, and lastly liquid from peripheral portion 76 passes to the upper surface of dome 14. The liquid passes through the pores in porous dome 14 by capillary action and by positive pressure displacement. The pores in dome 14 are sufficiently large to permit flow of the proper amount of liquid, but small enough to avoid formation of large droplets on the surface.

When the user releases the squeeze bottle, excess liquid on the top of dome 14 is pulled back into the applicator. The liquid is preferentially first removed from the peripheral portions and then from the intermediate portion and then from the central portion. The excess liquid is transported through chamber 66 and back through tube 26 along with air that replaces the volume of liquid removed from the reservoir and remaining in dome 14, owing to capillary forces, so that squeeze bottle 12 will maintain its shape. After the excess liquid has been removed, a predetermined amount of liquid remains within porous dome 14 for application to the user's skin. The preferential inward-out blooming when squeezing the bottle, and the preferential outward-in removal when releasing the bottle, avoids having product drip down the side of the applicator.

When the user slides porous dome 14 over the skin surface, a thin, uniform layer of liquid product is applied to the skin surface. The use of round particles in the sintered plastic of porous dome 14 provides a smooth comfortable surface and pores of the uniform size to provide capillary flow.

After use, cap 16 is then connected by mating projections 44 in grooves 42. This causes dome adapter 20 to be pushed downward from the position shown in FIG. 3 to the position shown in FIG. 4, and valve structure 60 moves downward to close opening 62 and prevent leakage of liquid from reservoir 90. Cap 16 locks into place in an on/off manner so that the user knows that it is sealed when it the cap is closed, in order to avoid leakage of liquid.

Other embodiments of the invention are within the scope of the appended claims.

What is claimed is:

1. An applicator for local application of a liquid to a person's skin comprising a porous dome having pores sized to provide liquid transport therein by capillary action, said dome having a generally circular shape, a chamber under said porous dome for containing said liquid in position to be transported into said dome, said chamber having a central portion and an outer annular portion that radially surrounds said central portion, a squeeze bottle providing a reservoir of said liquid under said chamber, said dome being mounted on said squeeze bottle, and a tube connected between said reservoir and said chamber such that increased pressure in said reservoir from squeezing said bottle causes liquid to flow from said reservoir to said chamber, and decreased pressure in said reservoir from releasing said bottle causes excess liquid in said chamber to flow from said chamber to said reservoir, said tube communicating with said central portion of said chamber so as to provide radial flow between said central portion and said outer annular portion all of the way around said central portion, said tube being an elongated tube that extends through and near to the bottom of the reservoir, and is sealed to said chamber so as to allow only liquid to flow from said reservoir into said chamber and to require it to flow through said tube.

2. The applicator of claim 1 further comprising a valve operable to block flow through said tube.

3. An applicator for local application of a liquid to a person's skin comprising a porous dome having pores sized to provide liquid transport therein by capillary action, a chamber under said porous dome for containing said liquid in position to be transported into said dome, a squeeze bottle providing a reservoir of said liquid under said chamber, said dome being mounted on said squeeze bottle, and a tube connected between said reservoir and said chamber such that increased pressure in said reservoir from squeezing said bottle causes liquid to flow from said reservoir to said chamber, and decreased pressure in said reservoir from releasing said bottle causes excess liquid in said chamber to flow from said chamber to said reservoir, said tube being an elongated tube that extends through and near to the bottom of the reservoir, and is sealed to said chamber so as to allow only liquid to flow from said reservoir into said chamber and to require it to flow through said tube, further comprising a valve operable to block flow through said tube, further comprising a cap that is connectable to said squeeze bottle, said cap covering said dome and causing said valve to be closed when said cap is connected to said squeeze bottle.

4. The applicator of claim 1 further comprising a dome adapter located between said squeeze bottle and said porous dome, and wherein said chamber is defined by said dome adapter and said porous dome.

5. The applicator of claim 4 wherein said dome adapter has a central passage and a valve structure at the bottom of said central passage, said valve structure being in fluid communication with said tube.

6. The applicator of claim 1 further comprising a bottle adapter connected to said bottle, and wherein said porous dome is movably mounted with respect to said bottle adapter.

7. The applicator of claim 6 wherein said bottle adapter has a central portion sealably connected to said tube, and an opening in communication with said tube.

8. The applicator of claim 7 further comprising a dome adapter, and wherein said chamber is defined by said dome adapter and said porous dome, and wherein said dome adapter has a central passage and a valve structure at the bottom of said central passage, said valve structure interacting with said opening to permit or block fluid communication between said chamber and said reservoir.

9. An applicator for local application of a liquid to a person's skin comprising a porous dome having pores sized to provide liquid transport therein by capillary action, a chamber under said porous dome for containing said liquid in position to be transported into said dome, a squeeze bottle providing a reservoir of said liquid under said chamber, said dome being mounted on said squeeze bottle, and a tube connected between said reservoir and said chamber such that increased pressure in said reservoir from squeezing said bottle causes liquid to flow from said reservoir to said chamber, and decreased pressure in said reservoir from releasing said bottle causes excess liquid in said chamber to flow from said chamber to said reservoir, said tube being an elongated tube that extends through and near to the bottom of the reservoir, and is sealed to said chamber so as to allow only liquid to flow from said reservoir into said chamber and to require it to flow through said tube, further comprising a bottle adapter connected to said bottle, and wherein said porous dome is movably mounted with respect to said bottle adapter, wherein said bottle adapter has a central portion sealably connected to said tube, and an opening in communication with said tube, further comprising a dome adapter, and wherein said chamber is defined by said dome adapter and said porous dome, and wherein said dome adapter has a central passage and a valve structure at the bottom of said central passage, said valve structure interacting with said opening to permit or block fluid communication between said chamber and said reservoir, further comprising a cap that is connectable to said squeeze bottle, said cap covering said dome and causing said valve structure to close said opening when said cap is connected to said squeeze bottle.

10. An applicator for local application of a liquid to a person's skin comprising a porous dome having pores sized to provide liquid transport therein by capillary action, a chamber under said porous dome for containing said liquid in position to be transported into said dome, a squeeze bottle providing a reservoir of said liquid under said chamber, said dome being mounted on said squeeze bottle, and a tube connected between said reservoir and said chamber such that increased pressure in said reservoir from squeezing said bottle causes liquid to flow from said reservoir to said chamber, and decreased pressure in said reservoir from releasing said bottle causes excess liquid in said chamber to flow from said chamber to said reservoir, said tube being an elongated tube that extends through and near to the bottom of the reservoir, and is sealed to said chamber so as to allow only liquid to flow from said reservoir into said chamber and to require it to flow through said tube, further comprising a bottle adapter connected to said bottle, and wherein said porous dome is movably mounted with respect to said bottle adapter, wherein said bottle adapter has a central portion sealably connected to said tube, and an opening in communication with said tube, further comprising a dome adapter, and wherein said chamber is defined by said dome adapter and said porous dome, and wherein said dome adapter has a central passage and a valve structure at the bottom of said central passage, said valve structure interacting with said opening to permit or block fluid communication between said chamber and said reservoir, further comprising a spring biasing said valve structure away from said opening.

11. The applicator of claim 10, wherein said spring is mounted between said bottle adapter and said dome adapter.

12. An applicator for local application of a liquid to a person's skin comprising a porous dome having pores sized to provide liquid transport therein by capillary action, a chamber under said porous dome for containing said liquid in position to be transported into said dome, a squeeze bottle providing a reservoir of said liquid under said chamber, said dome being mounted on said squeeze bottle, and a tube connected between said reservoir and said chamber such that increased pressure in said reservoir from squeezing said bottle causes liquid to flow from said reservoir to said chamber, and decreased pressure in said reservoir from releasing said bottle causes excess liquid in said chamber to flow from said chamber to said reservoir, wherein said chamber and said porous dome are dimensioned and shaped so as to provide preferential blooming of said liquid at the center of the dome first and subsequent blooming of liquid closer to the periphery of the dome.

13. An applicator for local application of a liquid to a person's skin comprising a porous dome having pores sized to provide liquid transport therein by capillary action, a chamber under said porous dome for containing said liquid in position to be transported into said dome, a squeeze bottle providing a reservoir of said liquid under said chamber, said dome being mounted on said squeeze bottle, and a tube connected between said reservoir and said chamber such that increased pressure in said reservoir from squeezing said bottle causes liquid to flow from said reservoir to said chamber, and decreased pressure in said reservoir from releasing said bottle causes excess liquid in said chamber to flow from said chamber to said reservoir, wherein said chamber and said porous dome are dimensioned and shaped so as to provide preferential blooming of said liquid at the center of the dome first and subsequent blooming of liquid closer to the periphery of the dome, wherein said chamber has a central volume area that communicates with said tube, a peripheral volume area, and constricted region connecting the central volume area to the peripheral volume area to provide said preferential blooming.

14. The applicator of claim 13 wherein said porous dome has a stepped recess surface with a central recess that provides said central volume area and, a peripheral recess that provides said peripheral volume area.

15. The applicator of claim 13 wherein said dome is made of sintered high-density polyethylene.

16. The applicator of claim 8 further comprising a collar that connects said dome adapter to said dome.

17. An applicator for local application of a liquid to a person's skin comprising a porous dome having pores sized to provide liquid transport therein by capillary action and a dome peripheral edge, a chamber under said porous dome for containing said liquid in position to be transported into said dome, a squeeze bottle providing a reservoir of said liquid under said chamber, said dome being mounted on said squeeze bottle, and a tube connected between said reservoir and said chamber such that increased pressure in said reservoir from squeezing said bottle causes liquid to flow from said reservoir to said chamber, and decreased pressure in said reservoir from releasing said bottle causes excess liquid in said chamber to flow from said chamber to said reservoir, said tube being an elongated tube that extends through and near to the bottom of the reservoir, and is sealed to said chamber so as to allow only liquid to flow from said reservoir into said chamber and to require it to flow through said tube, further comprising a bottle adapter connected to said bottle, and wherein said porous dome is movably mounted with respect to said bottle adapter, wherein said bottle adapter has a central portion sealably connected to said tube, and an opening in communication with said tube, further comprising a dome adapter having a dome adapter peripheral edge, and wherein said chamber is defined by said dome adapter and said porous dome, and wherein said dome adapter has a central passage and a valve structure at the bottom of said central passage, said valve structure interacting with said opening to permit or block fluid communication between said chamber and said reservoir, further comprising a collar that is connected to said dome adapter peripheral edge, said dome peripheral edge being sandwiched between said collar and said dome adapter peripheral edge, wherein said collar slidably contacts said bottle adapter.

18. The applicator of claim 17 wherein said dome adapter includes a sliding seal with said bottle adapter around said opening.

19. The applicator of claim 6 wherein said bottle adapter snaps onto said squeeze bottle.

20. The applicator of claim 1 wherein said porous dome is made of sintered plastic.

21. An applicator for local application of a liquid to a person's skin comprising a porous dome having pores sized to provide liquid transport therein by capillary action, a chamber under said porous dome for containing said liquid in position to be transported into said dome, a squeeze bottle providing a reservoir of said liquid wider said chamber, said dome being mounted on said squeeze bottle, and a tube connected between said reservoir and said chamber such that increased pressure in said reservoir from squeezing said bottle causes liquid to flow from said reservoir to said chamber, and decreased pressure in said reservoir from releasing said bottle causes excess liquid in said chamber to flow from said chamber to said reservoir, said tube being an elongated tube that extends through and near to the bottom of the reservoir, and is sealed to said chamber so as to allow only liquid to flow from said reservoir into said chamber and to require it to flow through said tube, wherein said porous dome is made of sintered plastic, wherein said sintered plastic is made of round particles.

22. The applicator of claim 20 wherein said sintered plastic has an average pore size between 10 and 30 microns.

23. A liquid applicator for local application of a liquid to a person's skin comprising a porous dome having pores sized to provide liquid transport therethrough by capillary action, said dome having a generally circular shape, a chamber under said porous dome for containing said liquid in position to be transported into said dome, said chamber having a central portion and an outer annular portion that radially surrounds said central portion, a squeeze bottle providing a reservoir of said liquid under said chamber, said dome being mounted on said squeeze bottle, and a tube connected to direct liquid from said reservoir to said dome, said tube being an elongated tube that extends through and near to the bottom of the reservoir, and is sealed to said chamber so as to allow only liquid to flow from said reservoir into said chamber and to require it to flow through said tube, said tube communicating with said central portion of said chamber so as to provide radial flow between said central portion and said outer annular portion all of the way around said central portion, wherein said bottle includes a relatively rigid molded open-end portion connected to said dome and an integral flexible, blow-molded reservoir portion that can be squeezed to a reduced volume condition to deliver liquid to said dome and has memory to return to an unsqueezed volume condition.

24. The applicator of claim 23 wherein said bottle is made of polyethylene terephthalate.

25. The applicator of claim 23 further comprising a bottle adapter connected to said open-end portion of said bottle, and wherein said porous dome is movably mounted with respect to said bottle adapter.

26. The applicator of claim 25 wherein said bottle adapter snaps onto said squeeze bottle.

* * * * *